US005636459A

United States Patent [19]

Huffman

[11] Patent Number: 5,636,459

[45] Date of Patent: Jun. 10, 1997

[54] DRAGLINE INCLUDING IMPROVED BOOM

[75] Inventor: Joseph L. Huffman, Mukwonago, Wis.

[73] Assignee: Harnischfeger Corporation, Brookfield, Wis.

[21] Appl. No.: 384,110

[22] Filed: Feb. 3, 1995

[51] Int. Cl.[6] ..... E02F 3/48; E02F 3/50

[52] U.S. Cl. ..... 37/395; 37/397; 52/223.8

[58] Field of Search ..... 37/394, 395, 397, 37/399; 212/347, 232; 52/116, 691, 639, 650.1, 223.8, 223.12

[56] References Cited

U.S. PATENT DOCUMENTS

| | | | |
|---|---|---|---|
| 1,851,346 | 3/1932 | Brown | 37/395 |
| 2,255,568 | 9/1941 | Page | 37/397 |
| 3,249,238 | 5/1966 | Hedeen | 212/347 |
| 3,516,183 | 6/1970 | Serota | 37/395 |
| 4,423,560 | 1/1984 | Rivinius et al. | 37/397 |
| 4,769,932 | 9/1988 | Kalve | 37/397 |
| 5,362,029 | 11/1994 | Kallenberger | 254/269 |
| 5,444,913 | 8/1995 | Nytray | 52/691 X |

*Primary Examiner*—Terry Lee Melius
*Assistant Examiner*—Thomas A. Beach
*Attorney, Agent, or Firm*—Michael, Best & Friedrich

[57] ABSTRACT

A dragline comprising a main housing, a bucket hoist mechanism mounted on the housing, a bucket drag mechanism mounted on the main housing, a moving mechanism for moving the main housing over the ground, a boom having upper and lower ends and a rectangular cross-section, the lower end being connected to the main housing, the upper end having thereon a sheave, the boom having a longitudinal axis and including a center section having top and bottom members parallel to the longitudinal axis, the center section having a neutral axis above the longitudinal axis, structure supporting the boom relative to the main housing, a bucket, a hoist rope extending between the bucket and the bucket hoist mechanism and over the sheave for causing vertical movement of the bucket, and a drag rope extending between the bucket and the bucket drag mechanism for causing horizontal movement of the bucket.

7 Claims, 3 Drawing Sheets

DRAGLINE INCLUDING IMPROVED BOOM

BACKGROUND OF THE INVENTION

1. Field of the Invention

The invention relates to a boom for draglines.

2. Discussion of Prior Art

A walking dragline typically includes a main housing, a boom which extends upwardly and outwardly from the main housing, and a mast assembly which extends upwardly from the main housing for supporting the boom. Support lines extend between the upper end of the mast assembly and the boom for supporting the boom relative to the mast assembly. The upper end of the boom has thereon a sheave mounted for rotation about a horizontal axis. A hoist rope extends from a bucket hoist mechanism and over the sheave to a bucket for causing vertical movement of the bucket. A drag rope extends from a bucket drag mechanism to the bucket for causing horizontal movement of the bucket relative to the boom. The main housing is supported by a tub that sits on the ground when the dragline is engaged in digging operations. The main housing is supported for pivotal movement relative to the tub in a lateral plane about a vertical axis. A pair of walking mechanisms are mounted on opposite sides of the main housing and are operable for moving the main housing over the ground between digging operations. The main housing includes an operator's cab adjacent to and generally beneath the boom. A stairway extends from the inner end to the outer end of the boom.

The boom comprises a welded frame including longitudinally extending upper and lower pairs of chords and lacing welded between the chords. The lower end of the boom includes a pair of spaced feet, and a horizontal foot axis extends between the feet. The boom is pivotally connected to the main housing at the feet and thus is pivotable relative to the main housing in a vertical plane about the foot axis. The boom has a longitudinal axis which extends between the midpoint of the foot axis and the point of the boom.

The distance between the upper and lower chords is referred to as the depth of the boom. The boom must have a depth which provides sufficient buckling strength in the vertical plane for a specified application. Ordinarily, in order to provide a particular vertical buckling strength, the depth must be greatest in the center of the boom.

When raising the bucket near the sheave, it is necessary for the operator to avoid running the bucket into the sheave and to avoid swinging the bucket into the boom. Ordinarily, because of the depth of the boom, the operator cannot see from the operator's cab the spacing between the sheave and the bucket and the spacing between the boom and the bucket when raising the bucket near the sheave. Tightlining can also cause the bucket to strike the boom.

SUMMARY OF THE INVENTION

The invention provides an improved dragline boom construction. The dragline has improved visibility of the spacing between the bucket and the sheave and between the bucket and the boom. Visibility is improved with the boom also having sufficient depth to provide a desired buckling strength in the vertical plane.

The invention provides a boom wherein, in one embodiment, the eccentricity of the center section is at least about 10% of the depth. In one embodiment, the eccentricity of the center section is at least about 18%.

The invention provides a boom wherein the bottom chord is spaced below the longitudinal axis by a distance less than about 5/16 of the depth.

More particularly, the boom includes a lower section, an upper section and a center section. The lower section includes a pair of spaced feet, and a horizontal foot axis extends between the feet. The boom is pivotable relative to the main housing in a vertical plane about the foot axis. The boom is rectangular in cross-section. In the preferred embodiment of the invention, the bottom and top chords in the center section are parallel to one another and to the longitudinal axis. The center section has a neutral axis which is equidistant from the top and bottom chords. The neutral axis is spaced above the longitudinal axis, and the center section eccentricity is at least 10% of the boom depth, and is preferably about 18% of the depth.

It is advantageous that the boom provides improved visibility from the operator's cab of the spacing between the sheave and the bucket and between the boom and the bucket.

It is a further advantage that visibility is improved by raising the bottom chords in the center section of the boom relative to the longitudinal axis of the boom and by increasing the eccentricity of the boom, such that the boom depth also provides sufficient vertical buckling strength.

It is an advantage that the boom in less likely to be hit and damaged by the bucket in a tightline condition.

It is a further advantage that the stairway extending along the boom is less steep and thus less hazardous than in some prior designs.

Other features and advantages of the invention will become apparent to those skilled in the art upon review of the following detailed description, claims and drawings.

Figure 1:
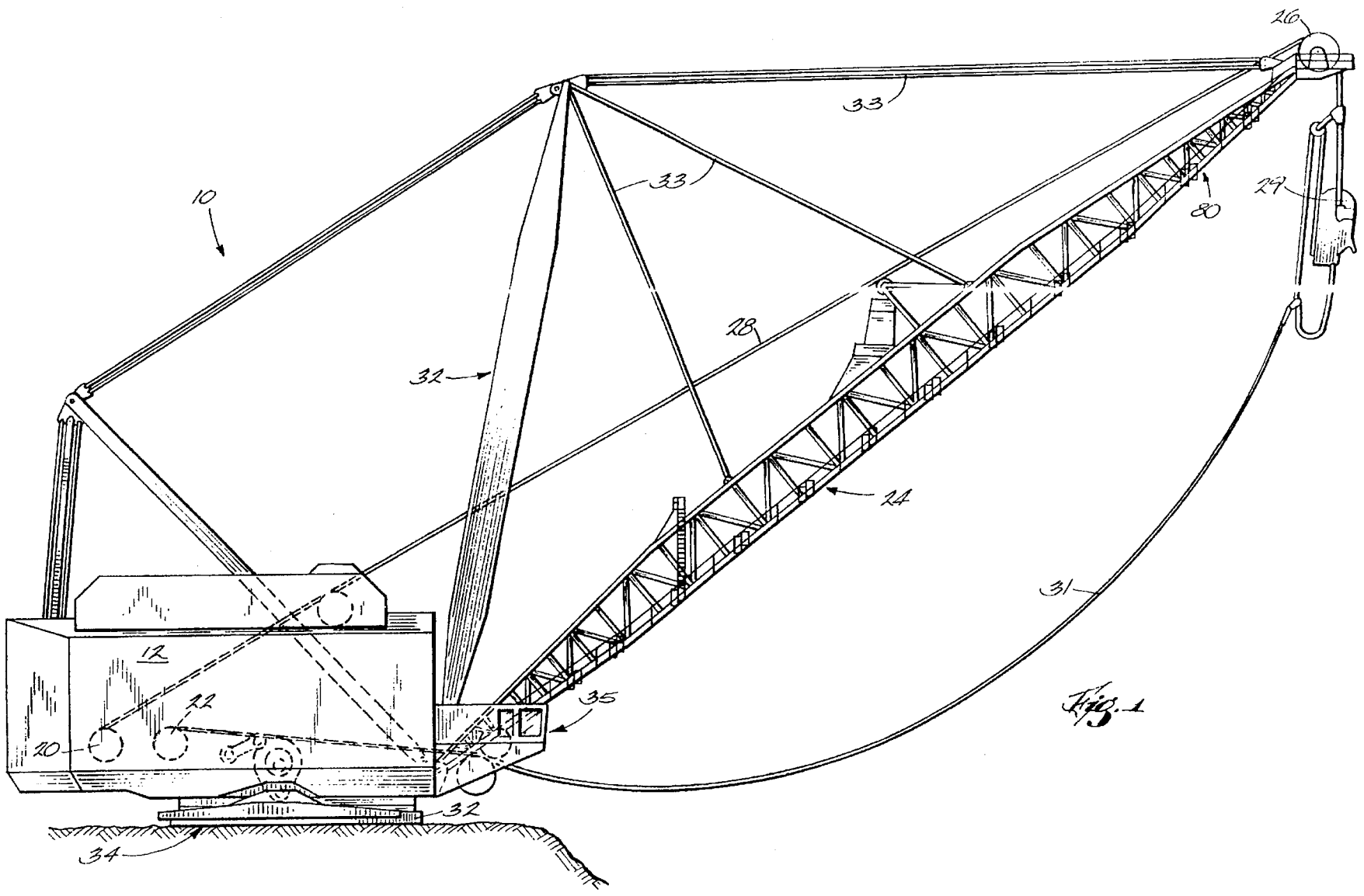
FIG. 1 is a side elevational view of a dragline embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A walking dragline 10 embodying the invention is illustrated in the drawings. The dragline 10 comprises (see FIG. 1) a main housing 12. The dragline 10 also comprises a bucket hoist mechanism 20 and a bucket drag mechanism 22, both of which are mounted on the main housing 12. A boom 24 extends upwardly and outwardly from the main housing 12. The upper end of the boom 24 has thereon a sheave 26 which is rotatable about a horizontal axis. A hoist rope 28 extends between the bucket hoist mechanism 20 and over the sheave 26 to a bucket 29 for causing vertical movement of the bucket 29 relative to the boom 24. A drag rope 31 extends from the bucket drag mechanism 22 to the bucket 29 for causing horizontal movement of the bucket 29. The boom 24 is supported relative to the main housing 12 by a conventional mast assembly 32. Support lines 33 are connected between the upper end of the mast assembly 32 and the boom 24 for supporting the boom 24 relative to the mast assembly 28. When the dragline 10 is digging, the main housing 12 is supported by a tub 32 that sits on the ground. The main housing 12 is supported for pivotal movement relative to the tub 32 in a lateral plane about a vertical axis. A pair of walking mechanisms 34 (one shown) move the main housing 12 over the ground between digging operations. The main housing 12 includes an operator's cab 35 adjacent to and generally below the boom 24. The dragline 10 as thus far described is conventional.

Figure 2:
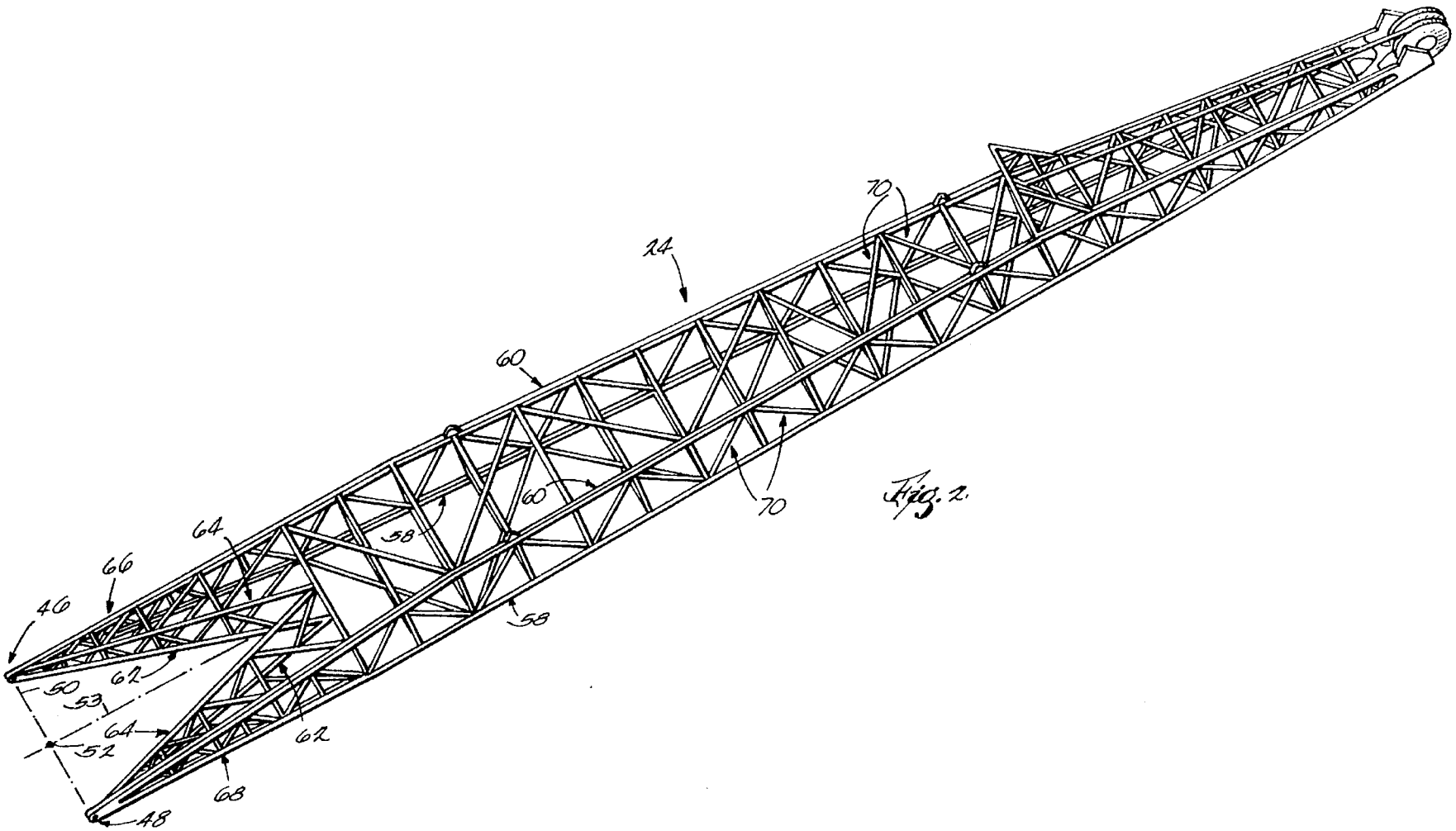
FIG. 2 is a perspective view of the boom.
Figure 3:
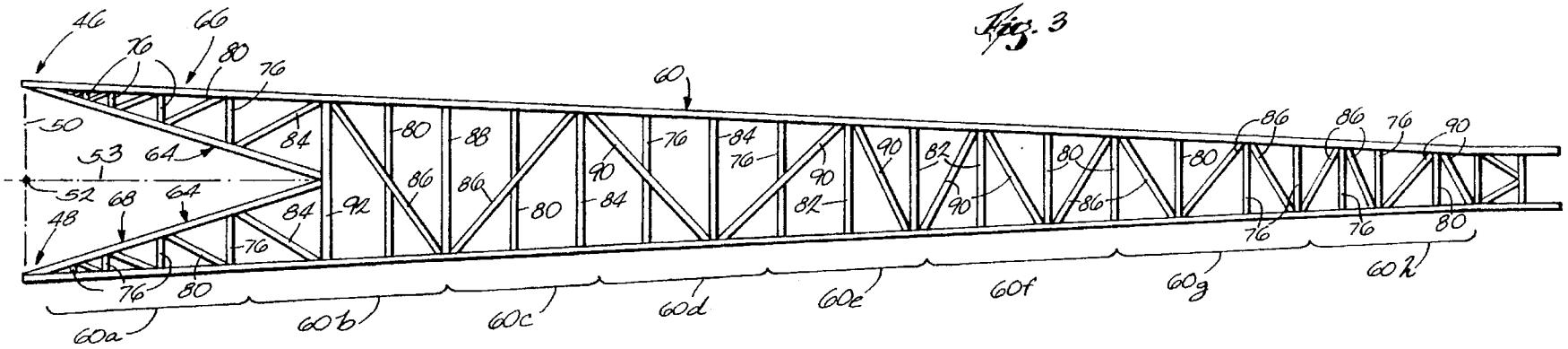
FIG. 3 is a top plan view of the boom.
Figure 4:
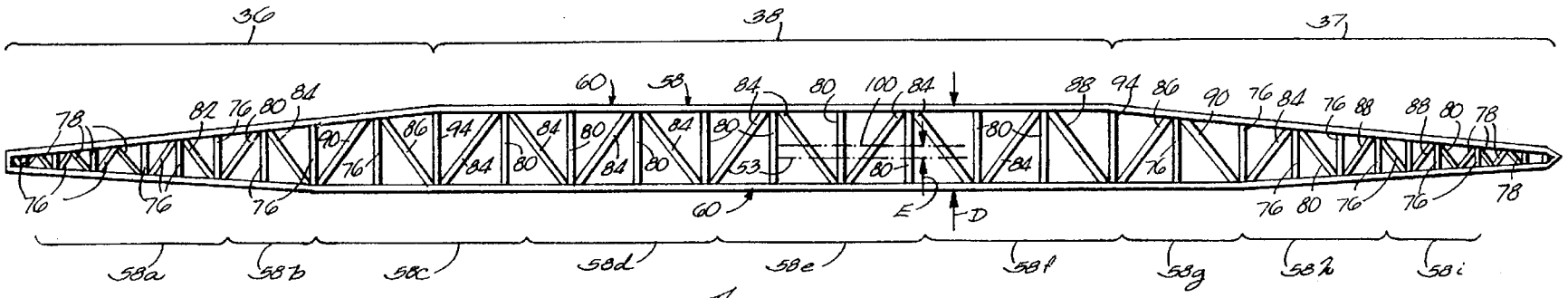
FIG. 4 is a side elevational view of the boom.

Referring to FIG. 4, the boom 24 includes a lower section 36, an upper section 37, and a center section 38 intermediate the lower and upper sections 36 and 37. The lower section 36 includes (see FIGS. 2 and 3) a pair of spaced feet 46 and 48. A horizontal foot axis 50 extends between the feet 46 and 48. The foot axis 50 has a midpoint 52 equidistant from the feet 46 and 48. The boom 24 is pivotally connected to the main housing at the feet 46 and 48. The boom 24 thus is pivotable relative to the main housing 12 in a vertical plane about the foot axis 50. The boom has a longitudinal axis 53 which extends in a straight line from the foot axis midpoint 52 to the point of the boom 24. The operator's cab 35 is forward of and elevated above the foot axis 50.

In the illustrated embodiment, the boom 24 is rectangular in cross-section. The boom 24 includes (see FIG. 2) a pair of bottom members or chords 58 which extend longitudinally between the feet 46 and 48 and the upper end. The boom 24 also includes a pair of top members or chords 60 which are spaced above the bottom chords 58 and which extend longitudinally between the feet 46 and 48 and the upper end. The boom 24 also includes a pair of minor bottom chords 62 and a pair of minor top chords 64 which extend longitudinally from the feet 46 and 48 and converge in respective V's. The bottom and top chords 58 and 60 and the minor bottom and top chords 62 and 64 thus cooperate to define a pair of legs 66 and 68 of the boom 24. The legs 66 and 68 are rectangular in cross-section and include the feet 46 and 48, respectively.

In the specific embodiment illustrated, as shown in FIG. 4, the bottom and top chords 58 and 60 in the center section 38 are parallel to one another and to the longitudinal axis 53, the bottom and top chords 58 and 60 in the upper section 37 converge in the direction from the center section 38 to the upper end, and the bottom and top chords 58 and 60 and the minor bottom and top chords 62 and 64 in the lower section 36 converge in the direction from the center section 38 to the feet 46 and 48.

In the illustrated embodiment, the bottom and top chords 58 and 60 comprise wide-flanged beams or members of generally I-shaped cross-section. In other embodiments (not shown), the chords can be of another suitable configuration, such as tubular members. More specifically, in the illustrated embodiment each of the bottom and top chords 58 and 60 comprises multiple segments or sections. Each segment has a flange width of 14 inches.

Each bottom chord 58 includes (see FIG. 4): a first segment **58*a* which extends about 40 feet from the respective foot structure (which is about 7 feet in length) and which has a density of about 283 lbs/foot; a second segment 58*b* which extends about 18 feet from the segment 58*a* and which has a density of about 311 lbs/foot; a third segment 58*c* which extends about 42 feet from the segment 58*b* and which also has a density of about 311 lbs/foot; a fourth segment 58*d* which extends about 42 feet from the segment 58*c* and which has a density of about 283 lbs/foot; a fifth segment 58*e* which extends about 42 feet from the segment 58*d* and which also has a density of about 283 lbs/foot; a sixth segment 58*f* which extends about 42 feet from the segment 58*e* and which has a density of about 283 lbs/foot; a seventh segment 58*g* which extends about 24 feet from the segment 58*f* and which has a density of about 257 lbs/foot; an eighth segment 58*h* which extends about 30 feet from the segment 58*g* and which has a density of about 233 lbs/foot; and a ninth segment 58*i* which extends about 17 feet from the segment 58*h*, which is connected to the point or upper end structure (which is about 18 feet long) at the outer end, and which has a density of about 193 lbs/foot. Segments 58*c*–58*g* extend along a straight line parallel to the longitudinal axis 53. The center section 38 of the boom 24 includes part of segment 58*c*, segments 58*d* and 58*e*, and most of segment 58*f*. The segments 58*a*–58*b* extend at an angle from the segment 58*c*. The segments 58*h*–58*i* extend at an angle from the segment 58*g***.

Each top chord 60 includes (see FIG. 3): a first segment **60*a* which extends about 40 feet from the respective foot structure and which has a density of about 233 lbs/foot; a second segment 60*b* which extends about 43 feet from the segment 60*a* and which has a density of about 283 lbs/foot; a third segment 60*c* which extends about 30 feet from the segment 60*b* and which has a density of about 257 lbs/foot; a fourth segment 60*d* which extends about 38 from the segment 60*c* and which has a density of about 193 lbs/foot; a fifth segment 60*e* which extends about 32 feet from the segment 60*d* and which has a density of about 193 lbs/foot; a sixth segment 60*f* which extends about 40 feet from the segment 60*e* and which has a density of about 193 lbs/foot; a seventh segment 60*g* which extends about 38 feet from the segment 60*f* and which has a density of about 159 lbs/foot; and an eighth segment 60*h* which extends about 34 feet from the seventh segment 60*g* and which has a density of about 159 lbs/foot. The center section 38 of the boom 24 includes segments 60*c*–60*f*, which extend along a straight line parallel to the longitudinal axis 53. Segments 60*a*–60*b* extend at an angle from segment 60*c*. Segments 60*g*–60*h* extend at an angle from segment 60*f***.

In the illustrated embodiment, the minor bottom and top chords 62 and 64 comprise tubular members. Specifically, the minor bottom and top chords 62 and 64 comprise eight-inch double extra strong tubular members. Each of the minor bottom and top chords 62 and 64 extends about 68 feet from the respective foot structure to the apex of the V. The respective minor bottom and top chords 62 and 64 intersect at the apex of the V, which in the illustrated embodiment has an included angle of about 35.4°.

The boom 24 also includes (see FIG. 2) lacing 70 which extends laterally and vertically between chords. The lacing 70 thus spaces apart the chords in the lateral and vertical planes. The lacing 70 is welded to the chords. In the illustrated embodiment, the lacing 70 comprises tubular members having an annular cross-sectional configuration. In other embodiments (not shown), the lacing 70 can be of another suitable configuration. In the illustrated embodiment, the lacing 70 includes cross braces which extend perpendicular to the longitudinal axis 53 and angle braces which are transverse to the cross braces.

More specifically, in the illustrated embodiment the lacing 70 includes (see FIGS. 3 and 4) lacing members 76 comprising three-inch standard wall members, lacing members 78 comprising three-inch double extra strong members, lacing members 80 comprising four-inch standard wall members, lacing members 82 comprising five-inch standard wall members, lacing members 84 comprising six-inch standard wall members, lacing members 86 comprising six-inch extra strong members, lacing members 88 comprising eight-inch standard wall members, lacing members 90 comprising eight-inch extra strong members, and lacing members 92 comprising eight-inch double extra strong members. The lacing 70 also includes, at each end of the center section 38, a pair of wide-flange beam members 94 extending between the top chords 60 and the bottom chords 58.

As shown in FIG. 4, the center section 38 of the boom 24 has a depth D which is equivalent to the distance between the bottom and top chords 58 and 60 along a line perpendicular to the longitudinal axis 53 or perpendicular to the chords 58 and 60. The boom depth D remains constant in the center section 38. In the illustrated embodiment, the boom depth D in the center section 36 is about 16 feet. The center section 38 of the boom 24 has a neutral axis 100 which is equidistant from the top and bottom chords 60 and 58 and which is located in the same vertical plane as the longitudinal axis 53. Thus, the neutral axis is about eight feet from the bottom chords 58. The configuration of the boom 24 can be analyzed in two dimensions by projecting the longitudinal axis 53 and the neutral axis 100 into the same vertical plane as the chords on either side of the boom 24. The boom 24 also has an overall width which is equivalent to the distance between the laterally spaced bottom or top chords 58 or 60. The boom width increases in the direction from the upper end to the feet 46 and 48. The overall width of the boom 24 at the feet 46 and 48 is commonly known as the "footspread" of the boom. In the illustrated embodiment, the boom footspread is about 41 feet. The boom 24 has a length between the upper end and the feet. Although the boom 24 can be of any suitable length, in the illustrated embodiment, the boom length is about 320 feet.

In the center section 38 of the boom 24, the longitudinal axis 53 is about 5 feet from the bottom chords 58. The boom 24 is therefore "eccentric" in the center section 38, i.e., the neutral axis 100 is spaced from the longitudinal axis 53. In the illustrated embodiment, the center section 38 is "offset" upwardly, so that the neutral axis 100 is above the longitudinal axis 53. Accordingly, the center section 38 of the boom 24 has an eccentricity E, which is defined as the perpendicular distance between the longitudinal axis 53 and the neutral axis 100. Preferably, the eccentricity E of the center section 38 is at least 10% of the boom depth D. In the specific embodiment illustrated, the eccentricity of the boom 24 is about 3 feet, which is approximately 18.75% of the depth D.

The boom depth D is sufficient to provide a required buckling strength in the vertical plane. In the illustrated embodiment, the length (320 feet) and footspread (41 feet) are specified for the boom, and the required depth D of the boom is determined by equating the lateral buckling strength and the vertical buckling strength. According to this method, the boom depth D in the illustrated embodiment is about 16 feet. The eccentricity of the boom provides an eccentric bending moment which opposes the deadweight bending moment of the boom. Preferably, the eccentricity E is such that the eccentric bending moment is substantially equal to the deadweight bending moment of the boom supporting a loaded bucket. Such an arrangement avoids the boom from bending excessively upwardly under the eccentric bending moment and permits the bottom chords 58 to be positioned as near as possible to the longitudinal axis 53.

The dragline 10 includes a pair of stairways 80 (one shown) which are supported on the boom 24 and which extend from the lower end to the upper end of the boom 24. The stairway, particularly at the upper end of the boom, is less steep and thus less hazardous than in some prior designs.

Various features of the invention are set forth in the following claims.

I claim:

1. A dragline comprising a main housing, a bucket hoist mechanism mounted on said housing, a bucket drag mechanism mounted on said main housing, a moving mechanism for moving said main housing over the ground, a boom having upper and lower ends and a rectangular cross-section, said lower end being connected to said main housing, said upper end having thereon a sheave, said boom having a longitudinal axis, said boom including a center section having top and bottom members parallel to said longitudinal axis, said center section having a neutral axis above said longitudinal axis, said center section having a rectangular cross section, said boom including a lower section having top and bottom members which are not parallel to said longitudinal axis and which converge from said center section toward said lower end, said boom including an upper section having top and bottom members which are not parallel to said longitudinal axis and which converge from said center section toward said upper end, said lower end being connected to said main housing for pivotal movement relative thereto about a generally horizontal lower axis, said sheave being mounted for rotation about a generally horizontal upper axis, and said longitudinal axis extending through said upper and lower axes, structure supporting said boom relative to said main housing, a bucket, a hoist rope extending between said bucket and said bucket hoist mechanism and over said sheave for causing vertical movement of said bucket, and a drag rope extending between said bucket and said bucket drag mechanism for causing horizontal movement of said bucket.

2. A dragline as set forth in claim 1 wherein said neutral axis is spaced above said longitudinal axis a distance greater than 10% of the distance between said top and bottom members of said center section.

3. A dragline as set forth in claim 2 wherein said neutral axis is spaced above said longitudinal axis a distance greater than 18% of the distance between said top and bottom members of said center section.

4. A dragline comprising a main housing, a bucket hoist mechanism mounted on said housing, a bucket drag mechanism mounted on said main housing, a moving mechanism for moving said main housing over the ground, a boom having upper and lower ends, said lower end being connected to said main housing, said upper end having thereon a sheave, said boom having a longitudinal axis, said boom including a center section having a rectangular cross section and having top and bottom members parallel to said longitudinal axis, said center section having a depth perpendicular to said longitudinal axis, and the distance between said longitudinal axis and said bottom member being less than approximately 5/16 of said depth, said boom including a lower section having top and bottom members which are not parallel to said longitudinal axis and which converge from said center section toward said lower end, said boom including an upper section having top and bottom members which are not parallel to said longitudinal axis and which converge from said center section toward said upper end, said lower end being connected to said main housing for pivotal movement relative thereto about a generally horizontal lower axis, said sheave being mounted for rotation about a generally horizontal upper axis, and said longitudinal axis extending through said upper and lower axes, structure supporting said boom relative to said main housing, a bucket, a hoist rope extending between said bucket and said bucket hoist mechanism and over said sheave for causing vertical movement of said bucket, and a drag rope extending between said bucket and said bucket drag mechanism for causing horizontal movement of said bucket.

5. A dragline as set forth in claim 4 wherein said center section has a neutral axis spaced above said longitudinal axis a distance greater than 10% of said depth.

6. A dragline as set forth in claim 5 wherein said center section has a neutral axis spaced above said longitudinal axis a distance greater than 18% of said depth.

7. A dragline comprising a main housing, a bucket hoist mechanism mounted on said housing, a bucket drag mechanism mounted on said main housing, a moving mechanism for moving said main housing over the ground, a boom having upper and lower ends and a rectangular cross-section, said lower end being connected to said main housing for pivotal movement relative thereto about a generally horizontal lower axis, said upper end having thereon a sheave mounted for rotation about a generally horizontal upper axis, said boom having a longitudinal axis extending through said upper and lower axes, said boom including a center section having top and bottom members parallel to said longitudinal axis, said boom including a lower section having top and bottom members which are not parallel to said longitudinal axis and which converge from said center section toward said lower end, and said boom including an upper section having top and bottom members which are not parallel to said longitudinal axis and which converge from said center section toward said upper end, said center section having a neutral axis spaced above said boom longitudinal axis a distance greater than 18% of the distance between said top and bottom members of said center section, and the distance between said longitudinal axis and said bottom member being less than approximately 5/16 of the distance between said top and bottom members of said center section, structure supporting said boom relative to said main housing, a bucket, a hoist rope extending between said bucket and said bucket hoist mechanism and over said sheave for causing vertical movement of said bucket, and a drag rope extending between said bucket and said bucket drag mechanism for causing horizontal movement of said bucket.

* * * * *